US009051788B2

(12) United States Patent
Hofste et al.

(10) Patent No.: US 9,051,788 B2
(45) Date of Patent: Jun. 9, 2015

(54) APPARATUS AND METHOD FOR POSITION-SENSITIVE PIPE PROVISIONING IN TOP-DRIVE DRILLING

(75) Inventors: Bernd Hofste, Bad Bentheim (DE); Jürgen Volkers, Itterbeck (DE); Johannes Moβ, Nordhorn (DE)

(73) Assignee: BENTEC GMBH DRILLING & OILFIELD SYSTEMS, Bad Bentheim (DE)

( * ) Notice: Subject to any disclaimer, the term of this patent is extended or adjusted under 35 U.S.C. 154(b) by 485 days.

(21) Appl. No.: 13/392,862

(22) PCT Filed: Aug. 20, 2010

(86) PCT No.: PCT/EP2010/005120

§ 371 (c)(1),
(2), (4) Date: Feb. 27, 2012

(87) PCT Pub. No.: WO2011/023335

PCT Pub. Date: Mar. 3, 2011

(65) Prior Publication Data

US 2012/0152619 A1 Jun. 21, 2012

(30) Foreign Application Priority Data

Aug. 28, 2009 (DE) ..... 10 2009 039 022

(51) Int. Cl.
*E21B 19/06* (2006.01)
*E21B 19/08* (2006.01)

(52) U.S. Cl.
CPC ..... *E21B 19/06* (2013.01); *E21B 19/08* (2013.01)

(58) Field of Classification Search
CPC ..... E21B 19/06; E21B 19/065; E21B 19/066; E21B 19/47
USPC ..... 166/250.01, 77.52, 66; 175/40
See application file for complete search history.

(56) References Cited

U.S. PATENT DOCUMENTS

| | | | | |
|---|---|---|---|---|
| 4,489,794 | A | 12/1984 | Boyadjieff et al. | |
| 4,800,968 | A | 1/1989 | Shaw et al. | |
| 7,182,133 | B2 * | 2/2007 | Webre et al. | 166/250.01 |
| 2007/0251700 | A1 | 11/2007 | Mason et al. | |
| 2009/0110535 | A1 | 4/2009 | Pietras et al. | |
| 2011/0146969 | A1 | 6/2011 | Lutzhoeft et al. | |

FOREIGN PATENT DOCUMENTS

DE 10 2008 005135 A1 7/2009

OTHER PUBLICATIONS

International Search Report of PCT/EP2010/005120, mailed on Dec. 27, 2010, in the English and German languages.
Search Report dated Jun. 30, 2010, for German priority application No. 10 2009 039 022.7, in the German language.).

* cited by examiner

*Primary Examiner* — William P Neuder
(74) *Attorney, Agent, or Firm* — King & Spalding

(57) ABSTRACT

The invention relates to a handling device for drill pipes (18) and to a so-called top drive (16) comprising said handling device, a so-called pipe handler, and having means for detecting a position of an elevator bail (30) comprised by the handling device/pipe handler and for transmitting the associated position information, wherein the position information is transmitted from the pipe handler to, e.g., the top drive (16) and is converted into an electrical signal for detecting and avoiding potentially critical situations as a result of a position/deflection of the elevator bail (30).

19 Claims, 6 Drawing Sheets

APPARATUS AND METHOD FOR POSITION-SENSITIVE PIPE PROVISIONING IN TOP-DRIVE DRILLING

RELATED APPLICATIONS

This application is a national stage filing of and claims priority to international application PCT/EP2010/005120, filed on Aug. 20, 2010, and titled "Handling Device For Drill Pipes, Especially Devices Known As Pipe Handlers Or Top Drives With Pipe Handlers, And Operating Method Therefor," which designated the United States and which was published on Mar. 3, 2011 as WO 2011/023335 A1, and which claims the benefit of the filing date of German Patent Application No. 102009039022.7, filed on Aug. 28, 2009. The disclosures of each of the foregoing applications are hereby incorporated herein by reference.

FIELD OF THE INVENTION

The present invention relates to top-drive drilling.

BACKGROUND

The invention relates to a handling device for drill pipes used for deep drilling, e.g. for oil or natural gas exploration. For such a handling device, the designation "pipe handler" has established itself in the technical terminology and accordingly, the term "pipe handler" is used hereinafter as a synonym for the term "handling unit for drill pipe". A pipe handler is part of a so-called top drive, thus the drive unit vertically movable in the mast of a drilling rig, said drive unit comprising a drive aggregate, usually a motor, which sets the drill pipe in rotational movement for the drilling process. The top drive is divided into a fixed and a rotatable part. The fixed part comprises the drive aggregate, and the power supply and the connection for receiving or transmitting electrical signals for controlling and/or monitoring the top drive is carried out via the fixed part. The pipe handler is the rotatable part and the aggregates of the pipe handler are supplied via a hydraulic rotary feedthrough between the fixed and the rotatable parts of the top drive, namely in that hydraulic actuating elements, in particular pressure cylinders, and the like are pressurized by means of a hydraulic fluid with a pressure, e.g. for moving a so-called elevator bail or for activating holding grippers provided on a so-called torque arm for drill pipes.

Specifically for the elevator bails of the pipe handler, pivotability is provided because the elevator bails (usually two) carry on their end a so-called drill pipe elevator in order to remove drill pipe elements from storage and to deliver the removed drill pipe element to the holding gripper at the end of the torque arm. A certain amount of drill pipe elements is normally provided for storage vertically adjacent to or on the mast of the drilling rig and for this purpose, a so-called finger board is provided which is located in the region of the upper end of the stored drill pipe elements. Up to now, removing drill pipe elements from their storage position, but also the other way round, namely depositing drill pipe elements into a storage position, is carried out by manual control. For this, the top drive is moved into an adequate vertical position within the mast which allows picking up or depositing drill pipe elements. As soon as the top drive has reached this position, said elevator bail or each elevator bail is pivoted and a drill pipe element is picked up or deposited with the drill pipe elevator. However, a disadvantage of these previous implementations is that it is substantially left to the attention of the operator to carry out the necessary control processes for initiating and completing such handling processes. If, e.g., after depositing a drill pipe element, the elevator bails remain pivoted, a downward movement of the top drive is normally not possible without having to fear that the ends of an elevator bail contact the finger board or other elements in or on the mast of the drilling rig. It is in particular critical if in this manner damage is caused to the mast of the drilling rig or parts thereof which, in the worst case, can result in damage to persons, e.g. in that the finger board is damaged on which normally operators walk for picking up or depositing drill pipe elements.

Accordingly, it is an object of the invention to provide a pipe handler as a handling unit for drill pipes, a top drive comprising such a pipe handler, and a method for the operation or use of these units, wherein the above-mentioned disadvantages are avoided, and in particular to provide corresponding devices and methods by means of which a position monitoring of the pipe handler or for the pipe handler and/or the top drive with pipe handler is possible.

SUMMARY

This object is achieved according to the invention by a device with the features as described herein. As far as this is related to a pipe handler as a handling unit for drill pipes, thus as part of a top drive, with at least one elevator bail pivotable under the influence of at least one actuating element, wherein the elevator bail or the elevator bails hold a pipe drill elevator or a similar adaptor for receiving drill pipe elements or the like, means for detecting a position of the at least one elevator bail and means for transmitting the associated position information are provided for this purpose. As far as this is related to a top drive which, besides a fixed drive aggregate comprises the handling unit according to the invention as a rotatable pipe handler, means for detecting a position of the at least one elevator bail and means for transmitting associated position information are provided on the part of the pipe handler, and on the part of the fixed part of the top drive with better possibilities for receiving and transmitting signals, in particular electrical signals, for controlling and/or monitoring the top drive, means for receiving the position information and means for derivating a transmittable signal from the position information are provided.

To simplify the further description, instead of the term "at least one elevator bail", the term "the elevator bails" is used hereinafter and therefore also in the following description of an exemplary embodiment, thereby referring to the currently common embodiment using two elevator bails. However, the term "the elevator bails" means in each case "at least one or a plurality of elevator bails, in particular two elevator bails" but also "the elevator bail, each elevator bail or at least one of the elevator bails".

In one embodiment of the top drive, the means for detecting the position of the elevator bails involves a first measuring cylinder. Transmitting the position information detected with the first measuring cylinder is then carried out from the rotatable part of the top drive, thus from the handling unit—the pipe handler—to the fixed part of the top drive, thus across the pivotal point located between the two parts of the top drive.

The advantage of the invention is that upon receiving information about the position of the elevator bails (position information), a signal can be derivated based on which it is detectable if a vertical movement of the top drive or a rotational movement of the pipe handler is possible in a safe manner. Automatically triggered, but also manually triggered or triggerable movement processes in the mast of the drilling rig can then be linked to this information in order to reliably avoid dangerous conditions.

Advantageous configurations of the invention are subject matter of the sub-claims. References used in this context refer to the further refinement of the subject matter of the main claim through the features of the respective sub-claim; they are not to be understood as an abandonment of achieving an independent objective protection for the feature combinations of the related sub-claims. Furthermore, with regard to an interpretation of the claims in the case of a more detailed specification of a feature in a subsequent claim, it is to be assumed that such a limitation does not exist in the claims preceding in each case.

A pipe handler usually comprises a pivotable so-called tilting arm, the pivoting movement of which is transferred to the elevator bails; the elevator bails are pivotable via the tilting arm under the influence of the actuating element or of each actuating element. Preferably, it is provided accordingly that detecting a position of the elevator bails takes place on the tilting arm because, on the one hand, the deflection of the same is proportional to the deflection of the elevator bails and, on the other, with only one position detection, position information for the, e.g., two elevator bails comprised by the pipe handler is obtained.

For the handling unit, thus the pipe handler, it is provided that the latter acts as the rotatable part in a top drive comprising a fixed and a rotatable part, wherein fixed means that the respective part of the top drive is rotationally fixed while a vertical movability, for example during lowering or lifting the drill pipe, is possible and necessary at any time.

The position information can manifest itself in many different forms. Considered can be electrical signals, and in the case of electrical signals, a wireless or wired transmission, in general signals in electromagnetic form, thus, e.g., also light signals in the visible or non-visible range and the like which likewise can be transmitted in a wireless or wired manner, acoustic signals or signals which can be transmitted through hydraulic or pneumatic means or the like, and combinations of all of the above. If the position information is an electrical signal, preferably, a transmission via a slip ring arrangement from the rotatable part to the fixed part of the top drive can be considered. Alternatively or additionally, the position information can be transmitted in a wireless manner from a transmitter on the rotatable part of the top drive to a receiver, in particular a receiver on the fixed part of the top drive. Considered for wireless transmission are in particular radio signals, infrared signals, but also electromagnetic signal transmission using the respective common protocols such as, e.g., Bluetooth, GSM, etc. When using a transmitter/receiver combination for wireless transmission of position information, preferably, a local energy supply is considered. Wireless transmission of position information avoids the necessity of having to provide a slip ring transmission via the pivotal point between the two parts of the top drive. Also, it is beneficial if the necessary energy supply for the transmitter does not require the slip transmission. Accordingly, it can be provided that a local energy source, e.g. a battery or the like, is assigned to the transmitter. In order to be able to reliably detect and monitor a potential outage of the local energy supply, the data transmission between transmitter and receiver comprises not only position information but also a so-called sign of life which is output by the transmitter at a predefined or predefinable time or cyclically, and for which the receiver, upon regular receipt, registers and reports in each case the intact communication relation. If there is no sign of life, an error message or the like is triggered which, on the one hand, draws the personnel's attention to necessary maintenance and/or, on the other, with regard to safety of the installation, is incorporated in the control of the installation as an indication for potentially maximally pivoted elevator bails, because in the case of an interrupted communication relation, no position information is available and, accordingly, to avoid damage to property and persons, a potentially critical deflection of the elevator bails has to be assumed. Further possibilities for local energy supply are given by using solar cells or by generating the electrical energy necessary for operating the transmitter by means of the deflection process of the elevator bails.

In the embodiment of the pipe handler/top drive having a first measuring cylinder it is preferably provided that the first measuring cylinder is a hydraulic measuring cylinder and the position information can be transmitted via a hydraulic rotary feedthrough between the fixed part and the rotatable part of the top drive, wherein for transmitting the position information, one or a plurality of free so-called ports of the hydraulic rotary feedthrough are used. The hydraulic transmission of position information is particularly advantageous because for the field of application of a drilling rig, special conditions apply, in particular if explosion protection has to be ensured. In the case of electrical signal transmission, sparking can never be completely ruled out so that for regions subjected to explosion hazards only special devices, so-called "ex" devices can be used which, compared to corresponding conventional devices, are in some cases many times more expensive. In the case of hydraulic signal transmission, no sparking is to be feared. Accordingly, hydraulic signal transmission is noncritical even for regions subjected to explosion hazards, and using more expensive special devices is unnecessary.

In the case of hydraulic signal transmission it is preferably provided that on the fixed part of the top drive, a second measuring cylinder is provided for receiving the position information from the first measuring cylinder. From a respective position of the second measuring cylinder it is then possible, e.g. with a position measuring system that detects, e.g., the position of a movable piston in the second measuring cylinder, to derivate an electrical signal which is a measure for the position information received as the position (deflection) of the elevator bails.

As an alternative to a position measuring system or the like, it is also possible to consider means for derivating an electrical signal from a flow rate through a connecting line between the first and the second measuring cylinders.

Particularly preferred, it is provided that the first and the second measuring cylinders are hydraulically connected in a dual-channel manner, thus from a bottom side of the first cylinder to a bottom side of the second measuring cylinder, and from a rod side of the first measuring cylinder to a rod side of the second measuring cylinder. In this case, in contrast to only a single-channel transmission, that is, a connection between, e.g., only the two bottom sides, potential disturbances of the transmission of position information can be detected and, optionally, can even be immediately compensated. Thus, the position information reaches the second measuring cylinder with significantly increased certainty. For the means for derivating an electrical signal from a flow rate through a hydraulic connecting line between the first and the second measuring cylinder, it is then also possible to consider the dual-channel determination of the flow rate in each connecting line, wherein in this manner, the derivation of the electrical signal takes place in a dual-channel manner. For a dual-channel generation of the electrical signal with a position measuring system, a cylinder comprising a rod on the bottom side and also on the rod side can be considered, wherein in each case one position measuring system is assigned to in each case one rod.

Deriving an electrical signal from a flow rate through a hydraulic connecting line from the first measuring cylinder does not necessarily require a second measuring cylinder with piston and the like, but it is also possible to use a compensation reservoir instead.

An alternative preferred embodiment of means for detecting a position of the elevator bails at the pipe handler and for transmitting associated position information in the case of a top drive for handling drill pipe elements with a fixed and a rotatable part, the pipe handler, wherein the rotatable part comprises the elevator bails which are pivotable under the influence of the at least one actuating element, includes that said actuating element or each actuating element is a hydraulic cylinder acting as a slave cylinder, that said hydraulic cylinder or each hydraulic cylinder acting as a slave cylinder can be actuated directly or indirectly, namely by one or a plurality of cylinders acting as a master cylinder, and that for detecting a position of the elevator bails and for transmitting an associated position information, means for derivating an electrical signal from an associated position of at least one master cylinder and/or from a flow rate through a hydraulic connecting line between a master cylinder and a slave cylinder, thus at least one master cylinder and one slave cylinder, or one hydraulic connecting line to the slave cylinder are provided. This alternative of position detection takes place in the high pressure and working pressure range. In particular the flow rate in an element, e.g. a hydraulic connecting line, pressurized with a working pressure necessary for pivoting the elevator bails is determined. In contrast, when using the first measuring cylinder and optionally a second measuring cylinder, compared to this working pressure, much lower pressure conditions are involved which, compared to said working pressure, can be considered as approximately "pressureless" so that the first and/or the second measuring cylinders and connections therebetween have to meet correspondingly lower requirements. The alternative embodiment in which the position detection takes place with regard to components pressurized with the working pressure involves higher requirements regarding the sensor system to be used; however, additional components such as the first and possibly the second measuring cylinder and the connections thereof are no longer required so that both variants are each individually characterized by significant advantages.

Preferably, a limit switch or a pair of limit switches acts as a means for deriving an electrical signal from a respective position of the second measuring cylinder or from a respective position of the master cylinder. A limit switch is sufficient to provide the position information that the elevator bails or one elevator bail is pivoted by at least a certain deflection at which an undesirable contact with parts in or on the mast of the drilling rig is possible. With a pair of limit switches there is the possibility to detect at least two positions with regard to the deflection of the elevator bails, e.g., a position in which the elevator bails hang down perpendicular or substantially perpendicular from the pipe handler and in this respect does not pose the risk of touching parts in or on the mast, or another position at which an associated "danger zone" begins. With further limit switches it is also possible to detect a potential maximum deflection of the elevator bails.

If a limit switch or a pair of limit switches is mentioned here, then, in the case of elevator bails which, starting from a substantially vertical resting position, can be pivoted clockwise but also counterclockwise, two limit switches for each movement direction for detecting the entry into a potential danger zone and optionally two additional limit switches for detecting a maximum deflection in each movement direction are provided. Also, for detecting the resting position, a limit switch can be provided which preferably identifies minor deflections adjacent to the resting position as still being a resting position, or two limit switches are provided which in each case respond to minor deflections so that it can be assumed that if none of these limit switches is switched and in the case of a preceding corresponding switching sequence of the other limit switches, the elevator bails are located in the region defined as resting position by these two limit switches.

Alternatively or additionally to detecting individual positions of the elevator bails, a position measuring system can be considered as a means for derivating an electrical signal from a respective position of the second measuring cylinder or the master cylinder. The position measuring system delivers an analog signal as a measure for a position of the elevator bails and therefore is significantly more accurate than a derivation of an electrical signal with one or a plurality of limit switches.

As a further alternative for derivating an electrical signal, a flow sensor can be considered which monitors a flow rate through the hydraulic connecting line between master cylinder and slave cylinder and, e.g., integrates said flow rate. Thus, exactly as in the case of the derivation of an electrical signal from the flow rate through the hydraulic connecting line between the first and the second measuring cylinders, the signal delivered from the flow sensor is an analog signal that represents a measure for a position of the elevator bails.

All aforementioned configurations and embodiment variants have in common that the position information—through (fluid) mass flow, electrically or electromagnetically, and in a wireless or wired manner—is transmitted across the pivotal point located between the fixed and the rotatable part of the top drive.

The above-mentioned object is also achieved with a method for operating a top drive as described here and hereinafter in that a detected position of the elevator bails is used for enabling or disabling a vertical movement of the top drive in a mast of a drilling rig, in particular for enabling or disabling an electrical signal for triggering a vertical movement of the top drive. According to this aspect of the invention, the detected position is used for a logic operation of signals which can result in a vertical movement of the top drive. Such a signal can be generated in a manual, setup or automatic operation and is has to be ensured in any situation that no vertical movement of the top drive is possible if due to the position of the elevator bails, an undesirable contact with parts in or on the mast is possible.

Particularly preferred, it is provided that enabling or disabling the vertical movement takes place depending on a vertical position of the top drive. This aspect of the invention takes into account that certain vertical positions or vertical position ranges of the top drive are uncritical even in the case of pivoted elevator arms, whereas for other positions or position ranges, the ability of monitoring intended with the invention is advantageous. This is taken into account when enabling or disabling the vertical movement takes place depending on a vertical position of the top drive.

Additionally or alternatively, it is preferably provided that enabling or disabling a pivoting movement takes place depending on a vertical position of the top drive. This ensures that in a vertical top drive position which principally poses a high risk of collision, no pivoting or only limited pivoting of the elevator arms or at least only a pivoting of the elevator arms toward their resting position is possible.

A particularly preferred embodiment combines the reciprocal enabling and disabling processes for the elevator bails and the top drive. For the entire movability of the top drive, a maximum value for the pivotability of the elevator arms can be specified for each vertical position or for certain vertical position ranges. This results in an imaginary envelope which extends around the movement range of the top drive and up to which the elevator arms are maximally allowed to be pivoted. With the envelope or a number of individual support points on the envelope provided for electronically processing said envelope, a collision-free activation of the elevator bails and the top drive can be achieved. If in a vertical position of the top drive, the elevator bails are pivoted only to such an extent that the envelope is not reached, a further pivoting of the of the elevator bails or a vertical movement is possible. As soon as a deflection of the elevator bails results in an infringement of the envelope, no further deflection of the elevator bail or vertical movement of the top drive is permitted. Permitted is only a movement of the elevator bails toward their resting position. As soon as the infringement does not exist anymore, the vertical movement of the top drive is permitted again.

So far, the envelope, that is, an electronically processible equivalent of such an envelope, has been described for the derivation of switch-off conditions for certain movements. Moreover, the envelope can also be used for derivating reliable intermediate positions of a combined movement, thus a vertical movement of the top drive and a simultaneous pivoting of the elevator arms. If in the case of a combined movement starting from a position of the top drive, e.g. above the finger board, a position at the mast foot is to be approached and the elevator bails have to be pivoted to a maximum at this position, a maximum permissible value for the deflection is determined in each case during the downward movement of the top drive and based on the envelope, and the elevator bails are pivoted accordingly during the movement of the top drive. Then, the ends of the elevator bails quasi "slide" along the imaginary envelope and upon reaching the target position for the top drive, the elevator bails also have reached, or at least largely reached, their target position.

Particularly preferred is provided for a method for operating the top drive as described here and hereinafter that when actuating a first operating element by an operator, an instantaneous value of the detected position of the elevator bails is stored as an elevator bail target value, that when actuating a second operating element, the at least one actuating element for pivoting the elevator bails is activated, that a detected position of the elevator bails, which changes with the actuating element being activated, is detected as an elevator bail actual value and is compared with the elevator bail target value, and that the actuating element for pivoting the elevator bails is deactivated if the elevator bail target and current values correspond to each other within predetermined or predeterminable tolerances.

In this embodiment of the invention, by actuating the first operating element or optionally also by actuating an operating element for the first time in an operating procedure, a current position of the elevator bail can be detected for a later approach of a position ("teaching"). A later approach of the position of the pivoted elevator bail stored in this manner becomes possible due to the position detection of the elevator bails which, in principle, is initially provided for risk prevention. Thus, if according to this aspect of the invention, a stored position of the elevator bails is to be approached again at a later time, first, the actuating element provided for pivoting the elevator bail can be activated by actuating a second operating element or by a second actuation of an operating element in an operating sequence so that the pivoting of the elevator bails begins. This pivoting process can be monitored due to the now available position information, and the stored value can be compared in a manner known per se as an elevator bail target value with a respective current value (elevator bail actual value). Within this continuous comparison, a deactivation of the actuating elements takes place, thus a termination of the pivoting movement, if the elevator bail target value and the elevator bail actual value correspond to each other within predetermined or predeterminable tolerances. Instead of the just described proportional regulation for reaching a stored elevator bail position, any other suitable form of control can be employed (e.g. PI, PID) in order to achieve a further improved repeatability when approaching the stored elevator bail position.

More preferably, it is provided that upon actuation of the first operating element (or upon a first actuation of an operating element), a current vertical position of the top drive is also stored as a top drive target position, that upon actuating the second operating element (or upon a second actuation of the operating element), an aggregate for the vertical movement of the top drive is also activated, that a vertical position changing with the vertical movement of the top drive is compared as a top drive actual position with the top drive target position, and that the aggregate for the vertical movement of the top drive is deactivated if the top drive target position and top drive actual position correspond to each other within predetermined or predeterminable tolerances. This aspect of the invention is an extension, to the top drive itself, of the possibility for approaching stored positions in connection with pivoting the elevator bails so that through adequate operating actions, a composite or combined movement sequence can be triggered which, in the case of recurring tasks, significantly reduces the workload of the operating staff.

More preferably, with regard to the composite or combined movement process when pivoting the elevator bails and when lowering and/or lifting the top drive, it is provided that the activation of the aggregate for vertically moving the top drive and the activation of the actuating element triggering the pivoting movement of the elevator bails take place simultaneously or successively, in particular successively in such a manner that first the vertical movement of the top drive and subsequently the pivoting movement of the elevator bails take place. A chronology of the movement sequences in which first the vertical movement of the top drive is triggered has the advantage that after completion of this movement sequence, the top drive is (normally) in a position which allows pivoting the elevator bails. A coordination of the two movement sequences which otherwise can only be achieved with difficulties is then no longer required. However, a simple possibility to coordinate the movement sequences is that for the vertical position of the top drive, certain position ranges are defined and with each such position range in a control program, a maximal deflection of the at least one elevator bail is associated, e.g. the above-described envelope. The coordinated movement sequence can then take place such that, e.g. when lifting the top drive and simultaneously pivoting the elevator bails, in each movement range reached during lifting the top drive, a pivoting or further pivoting of the elevator bails up to the maximum position specified in each case for this movement range takes place. Once the top drive has finally reached its predefined end position, the elevator bails are already pivoted by an initial value, and reaching the target position specified for the elevator bails is done correspondingly faster. Positions approachable in this manner are in particular a position above a so-called mouse hole for picking up drill pipes elements there, a so-called over drill position, in which the elevator bails are laterally pivoted to allow a maximum lowering of the top drive so that lifting the drill pipe located in the borehole is possible as well as a finger board position as it is required for picking up drill pipe elements stored thereon.

An exemplary embodiment is described below in more detail by means of the drawings. Objects or elements corresponding to each other are indicated in all figures with the same reference numbers.

The exemplary embodiment or any exemplary embodiment is not to be understood as a limitation of the invention. Rather, within the context of the present disclosure, numerous alterations and modifications are possible, in particular variants, elements and combinations which, for example by combining or modifying individual features and elements or method steps described in connection with the general or special description and included in the claims and/or the drawings, can be taught to the person skilled in the art with regard to achieving the object.

DETAILED DESCRIPTION

Figure 1:
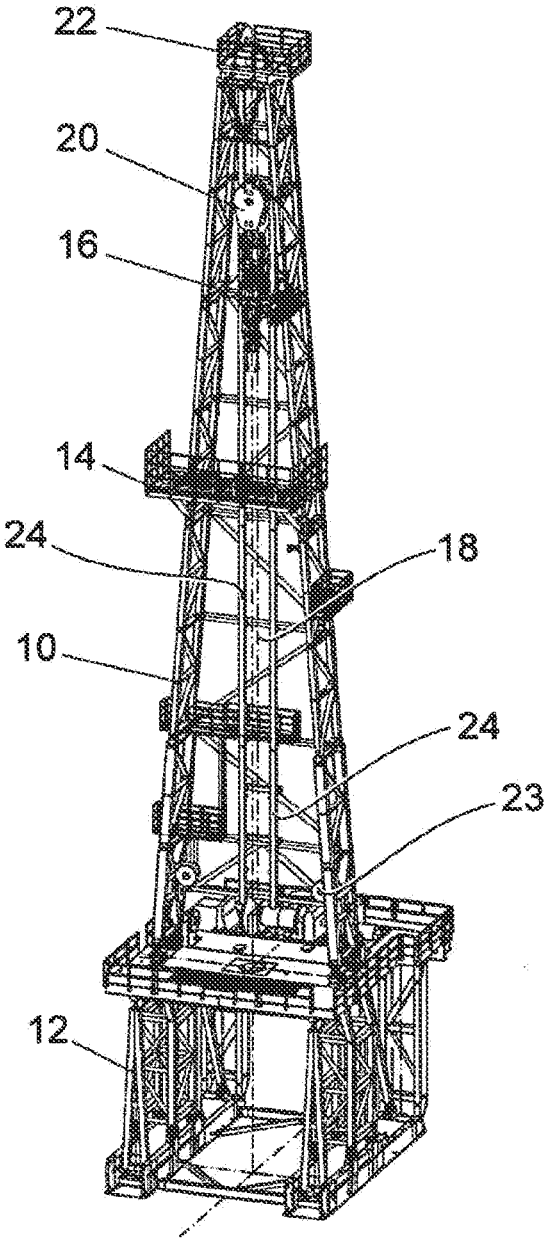
FIG. 1 shows, as part of a drilling rig, a mast with associated substructure and a top drive guided in the mast.

FIG. 1 shows, as part of a drilling rig, a mast 10 with associated substructure 12. Attached to the mast 10, in a manner known per se, is a so-called finger board 14, wherein the fingers comprised by said finger board are metal rods or metal profiles which are provided for uprightly, that is, vertically storing drill pipe elements deposited thereon. In the mast 10, a so-called top drive 16 is attached in a manner known per se which, during the operation of the drilling rig, is provided for lowering or lifting the drill pipe 18 (not illustrated, only indicated by dashed line) and for rotating the drill pipe 18 in order to perform the drilling process. The top drive 16 hangs from a roller block 20. The roller block 20 and a crown block 22 arranged in the region of a mast crown interact like a pulley. From the crown block 22, a pull rope (not illustrated) for a vertical movement of the top drive 16 runs to an aggregate provided in the region of the drilling rig, e.g. to a winch 23 drivable by an electric motor. For the vertical movement, the top drive 16 is held in guide rails 24.

Figure 2:
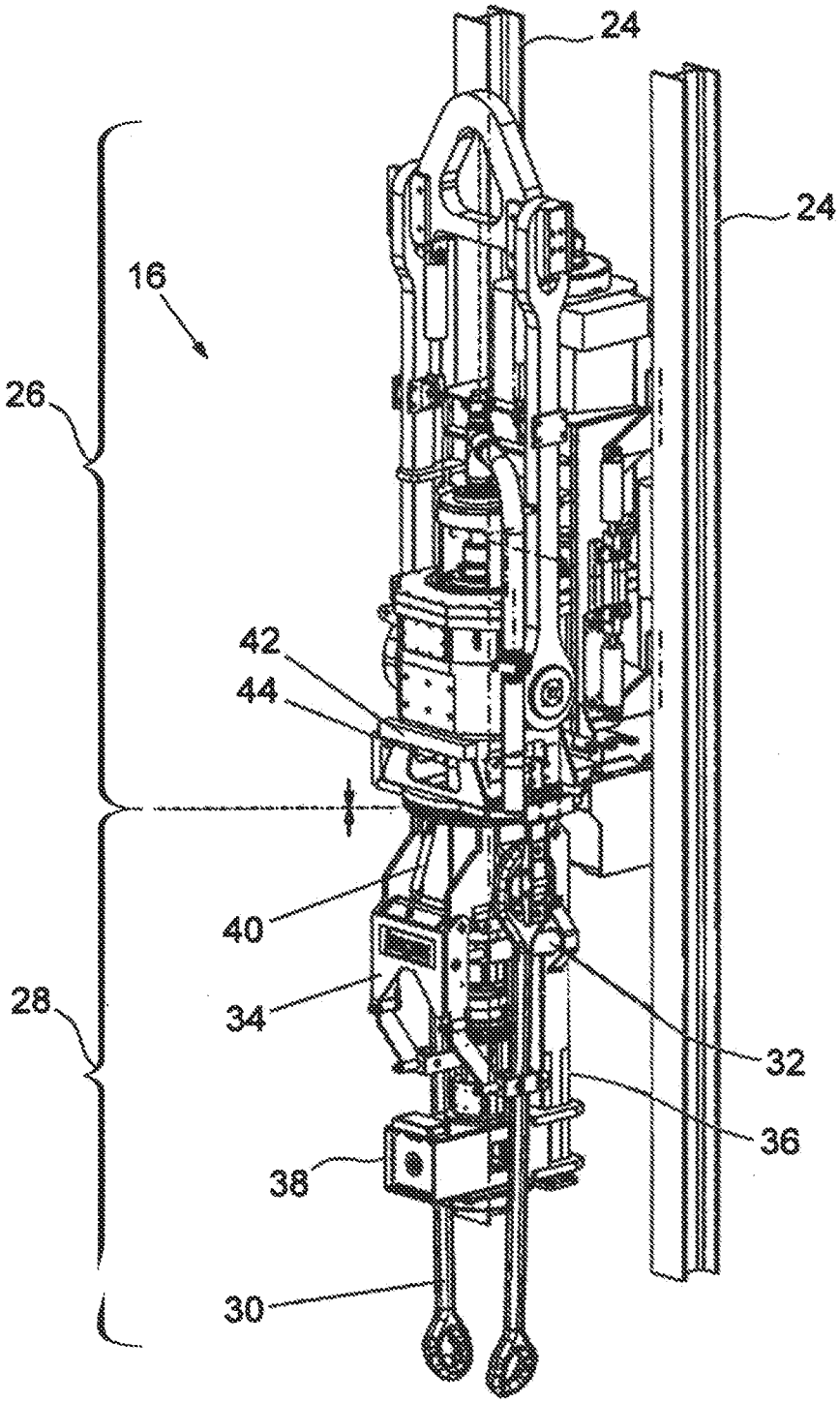
FIG. 2 shows the top drive with further details.

FIG. 2 shows the top drive 16 of FIG. 1 with further details. According to this, the top drive 16 comprises a fixed part 26 and a rotatable part 28. The fixed part 26 comprises the drive for moving the rotatable part 28, e.g. in the form of a motor. Accordingly, the fixed part 26 of the top drive 16 is also designated as a drive unit and fixed means that the rotationally fixed part of the top drive 16 is involved which, as a whole, is vertically movable in the guide rails 24. In technical terminology and accordingly also here, the rotatable part 28 of the top drive 16 is also designated as a pipe handler and comprises at least one pivotable elevator bail 30 and at least one actuating element 32 for initiating the pivoting process of the elevator bail or each elevator bail 30. In the illustrated embodiment, there are two elevator bails 30 and for each elevator bail 30, one actuating element 32 (only one is shown) is available. The use of the above-explained term "the elevator bails" with the defined meaning is continued accordingly.

In a resting position, the elevator bails 30 are substantially vertically aligned, i.e., the elevator bails hang vertically downward. At least in such a position, a vertical movement of the top drive 16 on the guide rails 24 in the mast 10 is possible without having to fear that the elevator bails 30 collide with parts in or on the mast 10, e.g. with the finger board 14 (FIG. 1) or one of the guide rails 24.

In the illustrated embodiment of the pipe handler, the actuating element 32 does not act directly on the elevator bails 30 but initially on a so-called tilting arm 34 which in turn is engaged with the elevator bails 30 so that a pivoting of the tilting arm 34 triggered by the at least one actuating element 32 results in a pivoting of the elevator bails 30. Accordingly, the actuating element 32 is often also designated as a tilting cylinder.

Further components of the top drive 16 or its pipe handler—without being of particular importance for the invention—are a so-called torque arm 36 and a holding gripper for drill pipes provided at the lower end of the torque arm.

For detecting a position of the elevator bails 30 and for transmitting associated position information, a first and a second measuring cylinder 40, 42 are provided in the illustrated embodiment of the top drive 16. The first measuring cylinder 40 is actuated with each movement of the tilting arm 34, and a hydraulic connection, which is arranged between the first and the second measuring cylinders 40, 42 and configured such that an actuation of the first measuring cylinder 40 by the tilting arm 34 has an effect on a position of the second measuring cylinder 42, is fed via a hydraulic rotary feedthrough 44 between the fixed part 26 and the rotatable part 28 of the top drive 16. Also, through this hydraulic rotary feedthrough 44, e.g. hydraulic fluid gets from the fixed part 26 of the top drive 16 to the actuating element or each actuating element 32 provided for pivoting the elevator bails 30. For each such hydraulic connection between the two parts 26, 28 of the top drive 16, a so-called port known per se is provided in the hydraulic rotary feedthrough 44, and for the connection between first and second measuring cylinders 40, 42, an additional port (or ports) is provided or a previously free port (or ports) is used.

Figure 3:
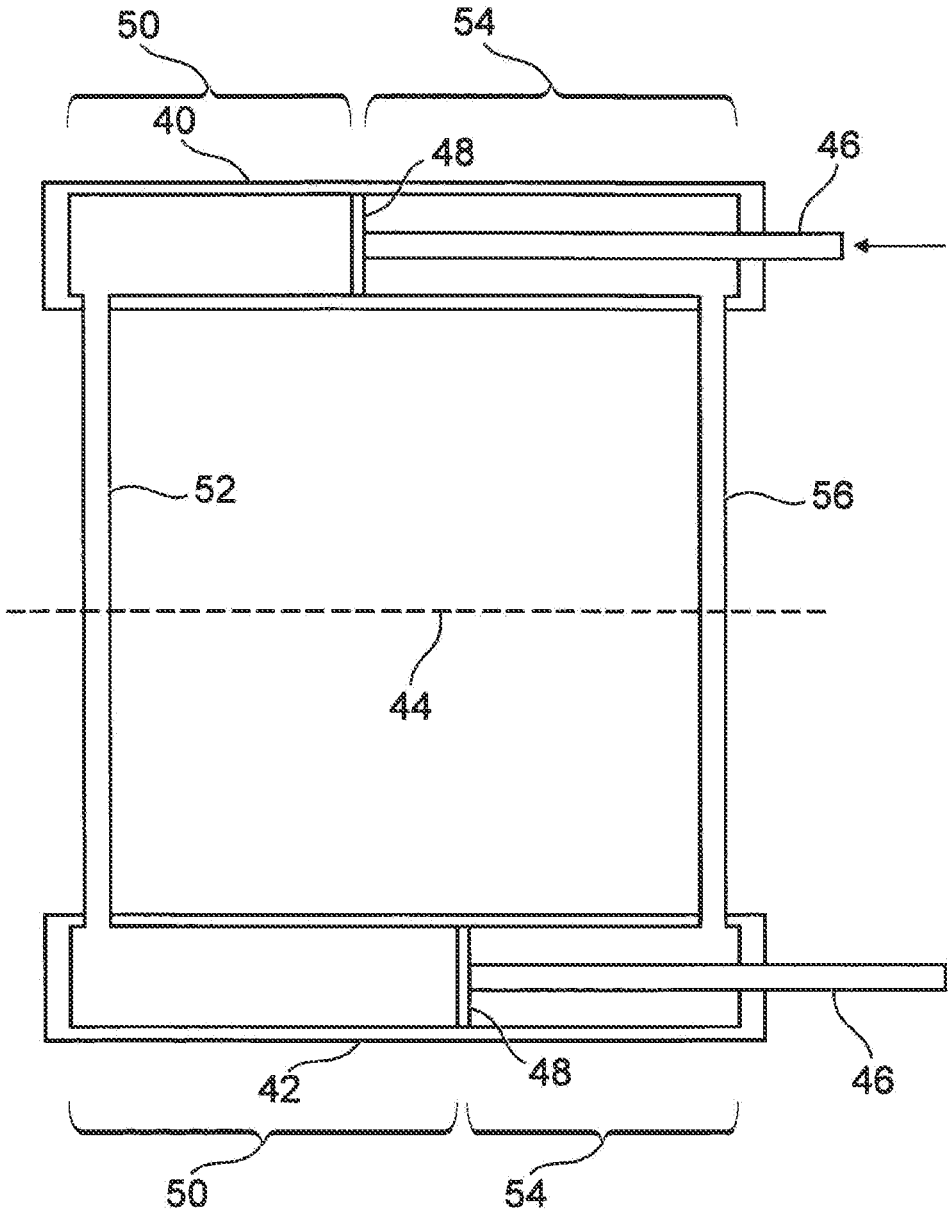
FIG. 3 shows the interactions between a first and a second measuring cylinder provided on the top drive, for detecting a position of an elevator bail on the top drive.

FIG. 3 shows a schematically simplified illustration of the interaction between first and second measuring cylinders 40, 42. Both measuring cylinders 40, 42 are cylinders, in particular hydraulic or pneumatic cylinders, comprising a piston 48 guided in a manner known per se on a rod 46. The first measuring cylinder 40 is actuated by the tilting arm 34 during a pivoting movement of the elevator bails 30. The arrow on the right side of the rod 46 of the first measuring cylinder 40 is meant to indicate this influence. With a movement of the piston 48 in the first measuring cylinder, a medium contained therein is displaced in a manner known per se and the displaced medium gets from a bottom side 50 to a corresponding bottom side 50 of the second cylinder 42 so that there, a movement of the piston 48 in the measuring cylinder 42 occurs which corresponds to the movement of the piston 48 in the first measuring cylinder 40. For this purpose, first and second measuring cylinders 40, 42 are connected by a line 52, in particular a hydraulic line, and the connection established in this manner comprises also the hydraulic rotary feedthrough 44 (cf. also FIG. 2) which is illustrated in FIG. 3 only as a dashed line.

Deviating from the embodiment according to FIG. 3, the hydraulic connection between the first and the second cylinders 40, 42 can also be carried out from the bottom side 50 of the first measuring cylinder 40 to a rod side 54 of the second measuring cylinder 42, or from the rod side 54 of the first measuring cylinder 40 to the bottom side 50 of the second measuring cylinder 42. So far, the illustrated line 52 is only one of a plurality of principally equivalent connections. However, the illustration in FIG. 3 also shows a particularly preferred embodiment of the (hydraulic) connection between the first and the second measuring cylinders 40, 42, namely a dual-channel connection which, in addition to the first line 52, also comprises a further line 56. Via the hydraulic rotary feedthrough 44, the illustrated further line 56 connects the two rod sides 54 of the first and the second measuring cylinders 40, 42. The dual-channel connection (first line 52, second line 56) effects that both pistons 48 of the measuring cylinders 40, 42 connected, e.g., in a hydraulic circuit are subjected to tensile and also compressive stress during a position change of the piston 48 in the first measuring cylinder 40, caused by the tilting arm 34, so that a potentially disturbed transmission of position information via a first or second line 52, 56 is supported by a corresponding position information via the remaining line 52, 56.

This means that the position information transmitted with regard to the position of the elevator bails 30 is the volume of the medium (e.g. hydraulic fluid) provided in the measuring cylinder 40 and moved by the piston 48 of said first measuring cylinder. Transmitting the position information, namely in the form of a volume flow, can be carried out via the rotary feedthrough 44 between the fixed and the rotatable parts 26, 28 of the top drive 16 since via this rotary feedthrough 44, feeding of, e.g., hydraulic fluid for deflecting the elevator bails 30 is also carried out in the case of previously known top drives. The resulting volume flow from the first to the second measuring cylinder 40, 42 is insofar only a further volume flow fed through the rotary feedthrough 44 which, in addition, is subjected or can be subjected to a significantly lower pressure than it is the case for a volume flow fed to the actuating element or each actuating element 32 for pivoting the elevator bails 30.

The position of the second measuring cylinder 42 is detected by a non-illustrated sensor. As a sensor, a limit switch or a group of limit switches, e.g. a pair of limit switches can be considered. A limit switch can be arranged, e.g., in such a manner that a certain deflection of the second measuring cylinder 42 is detected, wherein the limit switch position selected for this purpose corresponds to a deflection of the elevator bails 30 that needs to be monitored. An actuation of this limit switch means that the elevator bails 30 have reached at least the predetermined deflection, and the predetermined deflection can involve a deflection at which a contact of the elevator bails 30 with parts in or on the mast 10 is to be feared. In particular if the elevator bails 30 are pivotable clockwise and also counterclockwise, two such limit switches will be provided in order to be able to monitor the occurrence of a potentially critical deflection position. Another approach can additionally or alternatively be focused on monitoring a resting position of the elevator bails 30, wherein leaving the resting position is each time evaluated as a principally critical deflection situation.

While with regard to the detection of position information delivered by the first measuring cylinder, one or a plurality of limit switches can be regarded as a digital sensor or digital sensors, it is preferably also possible to consider an analog sensor, e.g. a sensor for position detection (position measuring system) instead of or in addition to a digital recording of measurements. The detected displacement for the embodiment illustrated in FIG. 3 is the deflection of the piston 48 of the second measuring cylinder 42, wherein said displacement can be detected directly on the piston 48 or on the rod 46. As position measuring sensors, position measuring sensors known per se can be considered, e.g. incremental encoders, and as the measuring principle underlying the analog sensor, any known measuring principle, e.g. on an ohmic, inductive, capacitive or piezoelectrical basis, etc, can be considered.

Figure 4A:
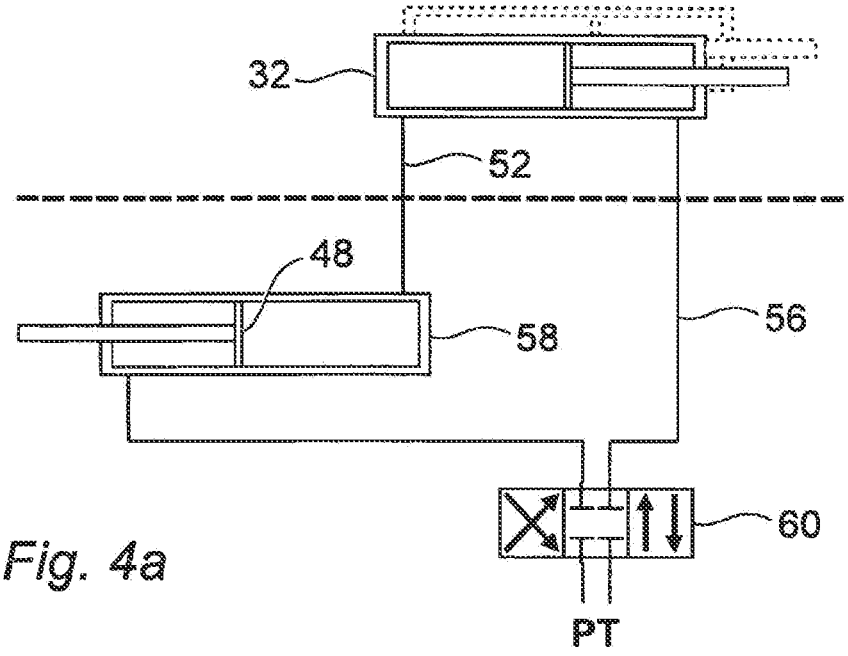
FIG. 4 shows an alternative embodiment for detecting a position of an elevator bail
Figure 4B:
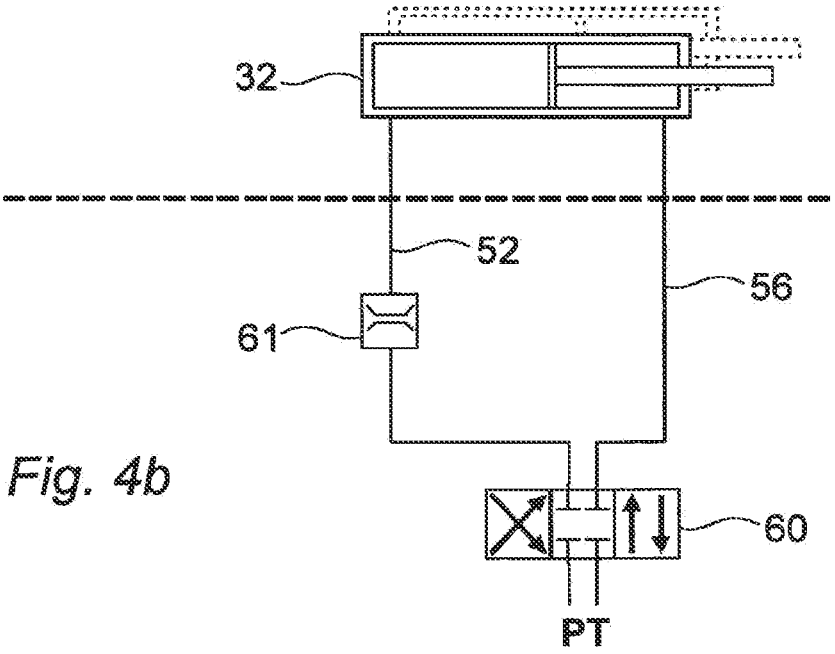

Another embodiment for detecting a position of the elevator bails 30 and for transmitting associated position information is illustrated in FIG. 4*a* and FIG. 4*b*. FIG. 4*a* and FIG. 4*b* show in each case one (optionally two) hydraulic cylinder in the upper region as an actuating element 32 for pivoting the elevator bails 30. In the embodiment according to FIG. 4*a*, the actuating element or each actuating element 32 acts, with regard to a flow direction of the hydraulic fluid, as a slave and is fed via a master cylinder 58 arranged on the fixed part 26 of the top drive 16, that is, on the other side of the rotary feedthrough 44. A pivoting movement of the elevator bails 30 is triggered here by suitably controlling a valve 60 (directional control valve) to a pressurized hydraulic fluid reservoir or a hydraulic aggregate, the valve being located on an inlet side of the master cylinder 58. The hydraulic fluid flow effected by controlling the valve 60 results in a movement in the master cylinder 58, which movement effects a movement of the slave, that is, in the actuating element or in each actuating element 32, and therefore effects the intended pivoting movement of the elevator bails 30. For detecting a position of the elevator bails 30 in this scenario, there is the possibility of detecting a piston 48 which is located in the master cylinder 58 and can be moved with a hydraulic fluid mass flow. In the illustrated configuration, the master cylinder 58 is situated in a working line (line 52; symbol "P" at the valve). Principally, a unit of the type of the master cylinder 58 can also be provided in a bleed line or drain line (line 56; symbol "T" at the valve). Moreover, position detection in the described manner can be considered in both lines 52, 56 so that again a dual-channel position detection is obtained.

FIG. 4*b* shows a variant which corresponds substantially to the embodiment according to FIG. 4*a*. Instead of the master cylinder 58 (FIG. 4*a*), a flow sensor 61 is provided. The latter is provided for measuring a flow rate through the line 52 between valve 60 and actuating element 32 (slave). Additionally or alternatively, a flow sensor 61 can also be provided in the further line 56. A flow sensor 61 in both lines 52, 56 renders the position detection with flow sensor into a dual-channel position detection. For a flow rate measurement, that is, for derivating a signal proportional to the respective volume flow, any flow rate measuring device or any flow sensor can be considered. The use of flow measuring devices or flow sensors can also be considered in the embodiment according to FIG. 3, whereby possibly a position measuring system can be replaced.

The advantage of the variants according to FIGS. 4*a* and 4*b* is that additional components such as the first and the second measuring cylinders 40, 42 (FIG. 3) are no longer required. However, in the case of the variant according to FIG. 4, the measurement has to take place under the influence of high pressure, whereas in the case of the variant according to FIG. 3, the pressure conditions in the first and second measuring cylinders 40, 42 can be lower, if applicable even by several orders of magnitude, than it applies to the actuating element 32 and its supply on the feeding side.

In all variants according to FIG. 3 or FIG. 4*a*, the dual-channel embodiment of the position detection is apparent. The dual-channel embodiment increases the safety of the measured value acquisition with regard to safety-oriented monitoring and, optionally, downstream controlling of the deflection of the elevator bails 30. The dual-channel embodiment can still be completed and improved, if needed, in that the measured value acquisition is performed with diversity. In the variant according to FIG. 3, e.g., a position measuring system is considered as a first electrical sensor, and a flow sensor is considered as a diverse second electrical sensor. In such a configuration, the derivation of an electrical signal from the position information supplied from the first measuring cylinder 40, in addition to the dual-channel connection (lines 52, 56) between the two measuring cylinders 40, 42, is carried out not only in a dual-channel manner, namely by two sensors, but in a dual-channel and diverse manner, that is, by two different sensors which are based on different measuring principles. Thereby, the error protection during the detection of the position of the elevator bails 30 is again significantly increased. The same can be implemented in the same manner or with a different sensor system in the embodiment illustrated in FIGS. 4*a* and 4*b*, e.g. in that in the variant according to FIG. 4*a*, in the further line 56, the flow sensor 61 of the variant according to FIG. 4*b* is provided, or vice versa.

The idea underlying the invention, namely detecting a position of the elevator bails 30 and transmitting associated position information can take place in many different ways in a redundant and/or diverse manner. On the part of the detection of the position information, the embodiment according to FIG. 3 is designed in a redundant manner in that from the bottom side 50 as well as the rod side 54 of the first measuring cylinder 40, position information as a measure for a deflection of the elevator bails 30 is output. The transmission of the associated position information is redundant as well because for transmitting the position information, the first and second connections (line 52, 56) through the hydraulic rotary feedthrough 44 are provided up to the second measuring cylinder 42. In that the second measuring cylinder 42 is coupled on its bottom side 50 as well as on its rod side 54 to the first measuring cylinder 40, receiving position information from the first measuring cylinder 40 is also carried out redundantly. Depending on type and number of the means provided in each case for derivating an electrical signal from a respective position of the second measuring cylinder 42, the electrical signal generation is also carried out redundantly or, if applicable, already here even diversely. Based on this general scheme, numerous alterations are conceivable without departing from the basic approach of the invention. Thus, e.g., in addition to the arrangement according to FIG. 3 or, e.g., instead of the rod-side coupling of the two measuring cylinders 40, 42 via the second line 56 to the first measuring cylinder 40, a transmitter can be provided which, depending on the position of the first measuring cylinder 40 (or the position of the tilting arm 34), outputs an electromagnetic signal which, on the part of the fixed part 26 of the top drive 16, is received by a corresponding receiver. The dual-channel nature of the detection of the position of the elevator bails 30 and the dual-channel transmission of associated position information remain unchanged in the course of this. However, the dual-channel nature in such an embodiment is not only a redundant dual-channel nature, but already a diverse dual-channel nature so that the error protection of the solution is increased overall.

For, e.g., electrical or electromechanical detection of a position of the elevator bails 30, additionally or alternatively, many different measurement and detection principles can be used: e.g., photosensitive elements pointing vertically or substantially vertically downward from the fixed part 26 of the top drive 16 in order to span a "light curtain" which is interrupted in the case of pivoted elevator bails 30 so that based on such an interruption, position information can be derivated with regard to the elevator bails 30; detection of a change of the electromagnetic field, caused by the pivoting of the elevator bails 30, below the fixed part 26 of the top drive 16, wherein for recorded characteristic values of the electromagnetic field, limit values or thresholds are stored or can be stored, wherein reaching or exceeding said limit values or thresholds is associated with certain pivot positions of the elevator bails 30 so that position information with regard to the elevator bails can be derivated therefrom. Further sensor systems which are not explicitly mentioned here can also be considered and each mentioned possibility for detecting the position of the elevator bails 30 can be provided in double or multiple versions for redundant, dual- or multi-channel detection and transmission of position information. Furthermore, any combination of mentioned sensor systems for dual- or multi-channel redundant, diverse position detection and transmission of position information can be provided.

Figure 5:
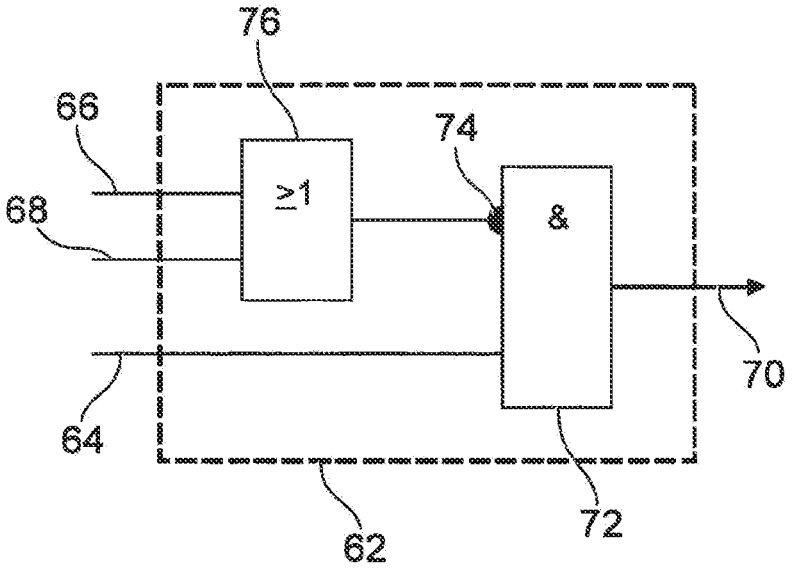
FIG. 5 shows a network for controlling a vertical movement of the top drive in consideration of the detected position of the elevator bail.

FIG. 5 shows exemplary a network 62 with logical operations as it can be used in a control program for controlling the vertical movement of the top drive 16 in consideration of the detected position of the elevator bails 30. The network 62 comprises a first and a second input 64, 66, optionally a further, third input 68 and an output 70. At the first input 64, the network 62 receives a signal which is intended to activate an aggregate for the vertical movement of the top drive 16. In the prior art, thus without consideration of the detected position of the elevator bails 30 during the vertical movement of the top drive 16, the network 62 or a similar logical operation is not required and the first input 64 is directly transmitted as an output 70 for controlling the respective aggregate. However, with an AND gate 72, the network 62 provides a logic AND operation of the first input 64 so that a signal is obtained at the output 70 only if a signal is available at the first input 64 and, at the same time, the position of the elevator bails 30 allows the first input 64 to interconnect to the output 70. For this, in addition to the first input 64, the AND gate 72 comprises a negating input 74, and the logic AND operation which is implemented through the AND gate 72, can only be fulfilled if no signal is available at the negating input 74, that is, no critical position of the elevator bails 30 is reported. For this, the second input 66 can principally be fed directly to the negating input 74 of the AND gate 72. FIG. 5 illustrates an embodiment in which redundant electrical signals regarding the position of the elevator bails 30 are present, which are fed to an OR gate 76 of the network 62 at the OR gate's inputs as second and thirds inputs 66, 68. During operation, the OR gate 76 causes that at its output, a signal is provided if at the second or the third input 66, 68 a critical position of the elevator bails 30 is signalized. The output of the OR gate 76 is inverted at the negating input 74 so that at least at one input 66, 68 signalizing a critical position, the logic operation implemented with the AND gate 72 can no longer be fulfilled and accordingly, a signal at the output 70 is suppressed. Thus, in the case of a critical position of the elevator bails 30, the aggregate provided for the vertical movement of the top drive 16 can no longer be activated. In the case of a redundant or diverse generation of electrical signals on position information of the elevator bail 30, the OR gate 76 allows separate consideration of both or a plurality of signals (in the case of further signals, the OR gate 76 receives additional inputs) so that in the case of only one critical signal, activability of a vertical movement of the top drive 16 is prevented.

Figure 6:
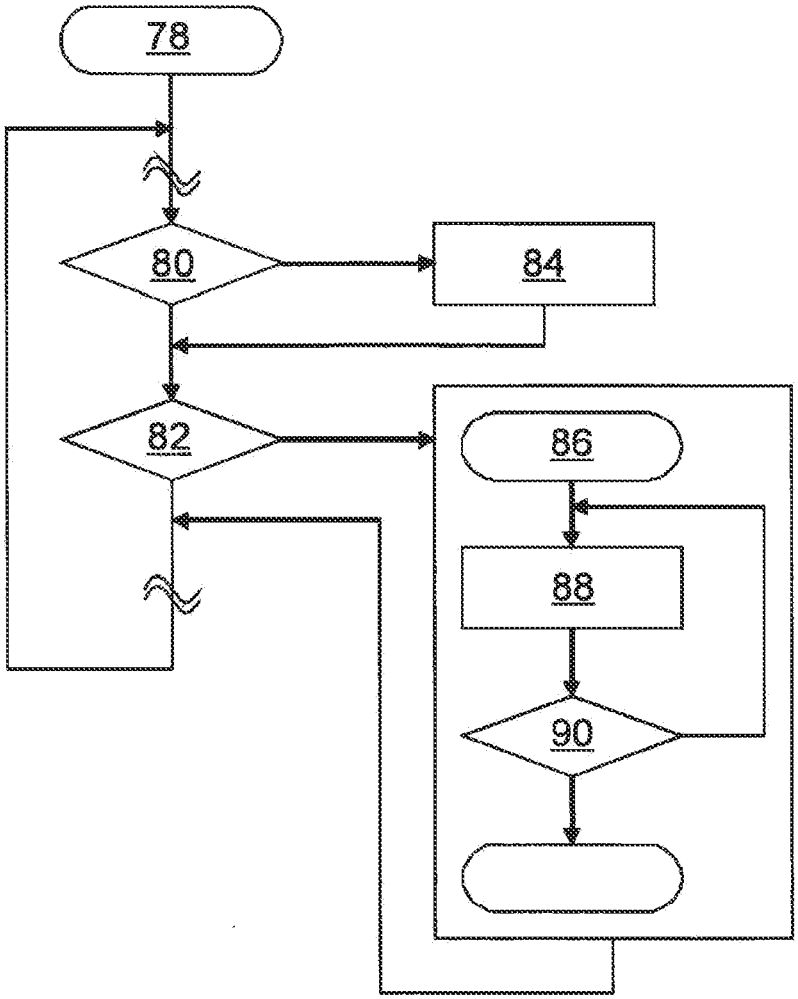
FIG. 6 shows a flow diagram for clarifying the aspect of the invention according to which position information for a subsequent movement toward the underlying position is recorded.

FIG. 6 finally shows a flow diagram for clarifying the aspect of the invention, according to which position information is recorded for subsequently approaching the underlying position. For this, the flow diagram in FIG. 6 shows in greatly simplified manner a portion of a control program 78 for controlling and/or monitoring individual aggregates in or on the mast 10 of a drilling rig. The control program runs substantially in an infinite loop, and for clarifying the mentioned aspects of the invention, only two branching blocks 80, 82 are illustrated, wherein the first branching block 80 checks if, e.g., a first operating element is actuated or if an operating element is actuated for the first time within an operating action. If the condition defined in this respect is met, that is, when actuating the operating element, the branch leads to a first function block 84 by means of which the associated position information, that is, e.g., the position information regarding a deflection of the elevator bails 30, is stored. After this, the branch runs back to the loop of the control program 78. The second branching block 82 checks if, e.g., a second operating element is actuated or if an operating element is actuated a second time within an operating action. If the condition defined in this respect is met, the branch leads to a sub-program 86 by means of which in a second function block 88, e.g., the actuating element 32 for pivoting the elevator bails 30, is activated. In a subsequent third branching block 90, a position of the elevator bails 30, which changes with the actuating element being activated, is compared as elevator bail actual value with an elevator bail target value stored by the first function block 84. As long as the condition implemented by the third branching block 90 is not fulfilled, a loop back to a position before the second function block 88 takes place during program execution. The actuating element 32 is deactivated when the condition is fulfilled, when elevator bail target and actual values correspond to each other within predetermined or predeterminable tolerances, and accordingly the otherwise active loop is left. After the end of the sub-program 86, the predetermined elevator bail target position is reached and the branch leads back to the infinite loop of the control program 78.

According to the principle of the flow diagram illustrated in FIG. 6, it is also possible that a "teaching"—that is, storing—and a subsequent approaching of a vertical position of the top drive 16 take place. For the activation of an aggregate required in this respect for the vertical movement of the top drive 16 (a function block corresponding to the second function block 88), a functionality as it is implemented by the network 62 according to FIG. 5 would be considered so that when approaching a top drive target position, it is monitored at any time if the actual deflection of the elevator bails 30 allows a vertical movement or a further vertical movement of the top drive 16.

Therefore, the invention can be presented as follows: A handling device for a drill pipe 18 and a top drive 16 comprising said handling device, a so-called pipe handler, and having means for detecting a position of an elevator bail 30 comprised by the handling device/pipe handler and for transmitting associated position information are provided, wherein the position information is transmitted from the pipe handler, e.g., to the top drive 16 and is converted into an electrical signal for detecting and preventing potential critical situations as a result of a position/deflection of the elevator bail 30. For transmitting the position information from the pipe handler, different variants are proposed. Combining individual variants results in dual-channel solutions which are beneficial with regard to their error protection. Combining different variants results in dual-channel diverse solutions which are further improved with regard to their error protection. The dual-channel nature and/or diversity is also possible when derivating electrical signals from the transmitted position information. Therefore, monitoring a position of the elevator bails 30 made possible for the first time through the availability of position information meets the highest demands with regard to an error-proof execution.

REFERENCE LIST

10 Mast
12 Substructure
14 Finger board
16 Top drive
18 Drill pipe
20 Roller block
22 Crown block
23 Winch
24 Guide rail
26 Fixed top drive part
28 Rotatable top drive part
30 Elevator bail
32 Actuating element
34 Tilting arm
36 Torque arm
38 Holding gripper
40 First measuring cylinder
42 Second measuring cylinder
44 Rotary feedthrough
46 Rod
48 Piston
50 Bottom side
52 Line
54 Rod side
56 Line
58 Master cylinder
60 Valve
61 Flow sensor
62 Network
64 First input
66 Second input
68 Third input
70 Output
72 AND gate
74 Negating input
76 OR gate
78 Control program
80 First branching block
82 Second branching block
84 First function block
86 Sub-program
88 Second function block
90 Third branching block

What is claimed is:

1. A pipe handler apparatus for handling drill pipe, the pipe handler apparatus comprising at least one pivotable elevator bail; a member coupled to the elevator bail, the member for applying force to affect an angular deflection of the elevator bail, the angular deflection defined as an angle between a longitudinal axis of the elevator bail and a longitudinal axis of the pipe handler; and a detector for sensing the angular deflection of the elevator bail and transmitting a signal indicative of the angular deflection.

2. The pipe handler apparatus of claim 1, wherein the detector is a flow rate detector.

3. The pipe handler apparatus of claim 1, wherein the member comprises a tilting arm coupled to the at least one pivotable elevator bail and an actuating element coupled to the tilting arm, wherein the detector is coupled to the tilting arm.

4. The pipe handler apparatus of claim 3, wherein the tilting arm is actuated in response to the signal indicative of the angular deflection.

5. A top drive unit comprising a fixed part for providing torque to the drill pipe; and a rotatable part coupled to the fixed part, the rotatable part comprising the pipe handler apparatus of claim 1.

6. The top drive unit of claim 5, wherein the detector is a flow rate detector that produces an electrical signal in response to fluid flow through a hydraulic line, and the signal travels between the rotatable part and the fixed part of the top drive.

7. The top drive unit of claim 6, further including a hydraulic rotary feedthrough between the rotatable part and the fixed part.

8. The top drive unit of claim 5, further including a wireless transmitter attached to the rotating part of the top drive; and a wireless receiver attached to the fixed part of the top drive; wherein the electrical signal travels between the wireless transmitter and the wireless receiver.

9. The top drive unit of claim 5, wherein a vertical motion of the top drive unit is controlled based on the signal indicative of the angular deflection.

10. The top drive unit of claim 5, wherein the top drive unit is prevented from moving in a vertical direction when the angular deflection exceeds a predetermined angular deflection.

11. The pipe handler apparatus of claim 1, wherein the signal indicative of the angular deflection comprises a measured amount of the angular deflection.

12. A method for operating a top drive drilling unit comprising detecting an angular deflection of an elevator bail, the angular deflection defined as an angle between a longitudinal axis of the elevator bail and a longitudinal axis of the top drive drilling unit; generating an electrical signal responsive to the angular deflection of the elevator bail; and controlling a vertical movement of the top drive unit in a mast of a drilling rig with input from the electrical signal.

13. The method of claim 12, wherein a vertical position of the top drive drilling unit determines the vertical movement.

14. The method of claim 12, wherein the angular deflection of the elevator bail depends on a vertical position of the top drive drilling unit.

15. The method of claim 12, further including an operator actuating a first operating element and determining an elevator bail target value from an instantaneous value of the detected angular deflection of the elevator bail; storing the elevator bail target value; actuating a second operating element and activating at least one actuating element responsive to the second operating element actuation; determining an actual value of the detected angular deflection of the elevator bail from a detected angular deflection of the elevator bail; comparing the actual value to the target value; and deactivating the at least one actuating element in response to a difference between the actual value and the target value being within a tolerance.

16. The method of claim 15, further including actuating the first operating element and determining a top drive target position from a current vertical position of the top drive unit; storing the top drive target position; actuating the second operating element and activating an aggregate for vertically moving the top drive; determining a top drive actual position from a vertical position that changes with vertical movement of the top drive; comparing the top drive actual position with the top drive target position; and deactivating the aggregate for vertically moving the top drive in response to a difference between the top drive target position and top drive actual position being within a tolerance.

17. The method of claim 16, wherein activating the at least one actuating element and activating the aggregate for vertically moving the top drive occur in succession such that the vertical movement of the top drive occurs prior to the angular deflection of the at least one elevator bail.

18. The method of claim 16, wherein activating the at least one actuating element and activating the aggregate for vertically moving the top drive occur simultaneously.

19. The method of claim 12, further comprising actuating a tilting arm to control the elevator bail in response to the electrical signal.

* * * * *